US009599937B2

(12) United States Patent
Nagata

(10) Patent No.: US 9,599,937 B2
(45) Date of Patent: Mar. 21, 2017

(54) IMAGE FORMING APPARATUS AND METHOD OF SEPARATING RECORDING MEDIUM

(71) Applicant: Atsushi Nagata, Kanagawa (JP)

(72) Inventor: Atsushi Nagata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/933,238

(22) Filed: Nov. 5, 2015

(65) Prior Publication Data

US 2016/0154345 A1 Jun. 2, 2016

(30) Foreign Application Priority Data

Nov. 28, 2014 (JP) ..... 2014-241242

(51) Int. Cl.
*G03G 15/14* (2006.01)
*G03G 15/16* (2006.01)

(52) U.S. Cl.
CPC ..... *G03G 15/1665* (2013.01); *G03G 15/1605* (2013.01); *G03G 15/1675* (2013.01); *G03G 2215/00257* (2013.01); *G03G 2215/00489* (2013.01); *G03G 2215/00763* (2013.01)

(58) Field of Classification Search
CPC ..... G03G 15/1665; G03G 2215/00257; G03G 2215/00489; G03G 2215/00763; G03G 15/5016; G03G 15/502
USPC ..... 399/315
See application file for complete search history.

(56) References Cited

U.S. PATENT DOCUMENTS 2,328,198 A * 8/1943 Davenport ..... B41M 5/20 162/135
2006/0083540 A1* 4/2006 Kadowaki ..... G03G 21/105 399/102
2009/0003898 A1 1/2009 Kayahara et al.
2009/0016786 A1 1/2009 Suzuki et al.
2009/0116880 A1 5/2009 Takagaki et al.
2010/0014897 A1 1/2010 Seto et al.
(Continued)

FOREIGN PATENT DOCUMENTS

EP 2 570 859 A2 3/2013
JP 63-85573 A * 4/1988
(Continued)

OTHER PUBLICATIONS

U.S. Appl. No. 14/712,307, filed May 14, 2015.
Extended European Search Report issued on Apr. 20, 2016 in Patent Application No. 15192670.6.

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

An image forming apparatus includes an image bearer to bear a visible image, a transfer device to transfer the visible image from the image bearer onto a recording medium, a separator to separate the recording medium from the image bearer, a separation bias application device to apply a separation bias to the separator; and a controller to control the separation bias. When the recording medium fed in the image forming apparatus is either a black sheet or a metallic sheet, the controller sets the separation bias smaller than a predetermined separation bias value for a reference sheet type other than the black sheet and the metallic sheet.

8 Claims, 3 Drawing Sheets

(56) References Cited

U.S. PATENT DOCUMENTS

| | | | | |
|---|---|---|---|---|
| 2010/0014903 | A1 | 1/2010 | Seto et al. | |
| 2010/0232844 | A1 | 9/2010 | Saito et al. | |
| 2010/0239292 | A1 | 9/2010 | Fujita et al. | |
| 2011/0311249 | A1 | 12/2011 | Kubota et al. | |
| 2012/0237868 | A1 | 9/2012 | Yamada et al. | |
| 2013/0045031 | A1 | 2/2013 | Nagata et al. | |
| 2013/0064559 | A1* | 3/2013 | Nakamura | G03G 15/1675 399/44 |
| 2014/0270819 | A1 | 9/2014 | Wada et al. | |
| 2014/0328604 | A1 | 11/2014 | Tanaka et al. | |
| 2015/0029518 | A1* | 1/2015 | Tashiro | G03G 15/5025 358/1.1 |
| 2015/0037054 | A1 | 2/2015 | Nagata et al. | |
| 2015/0117875 | A1* | 4/2015 | Kubo | G03G 15/0848 399/15 |

FOREIGN PATENT DOCUMENTS

| | | |
|---|---|---|
| JP | 2012-189929 | 10/2012 |
| JP | 2013-061453 | 4/2013 |

* cited by examiner

IMAGE FORMING APPARATUS AND METHOD OF SEPARATING RECORDING MEDIUM

CROSS-REFERENCE TO RELATED APPLICATIONS

This patent application is based on and claims priority pursuant to 35 U.S.C. §119(a) to Japanese Patent Application No. 2014-241242, filed on Nov. 28, 2014, in the Japan Patent Office, the entire disclosure of which is hereby incorporated by reference herein.

BACKGROUND

Technical Field

Embodiments of the present invention generally relate to an electrophotographic image forming apparatus, such as a copier, a printer, a facsimile machine, and a multifunction peripheral (MFP) having at least two of copying, printing, facsimile transmission, plotting, and scanning capabilities, and further relate to a method of separating a recording medium in the image forming apparatus.

Description of the Related Art

Generally, electrophotographic image forming apparatuses form a latent image on a uniformly charged surface of an image bearer by optically writing an image according to image data, developing the latent image with toner, transferring the toner image a recording medium either directly or indirectly via an intermediate transfer member such as an intermediate transfer belt, and fixing the image thereon.

Currently, there are image forming apparatuses that use white toner in addition to primary color toners of yellow (Y), cyan (C), magenta (M), and black (K) toners.

For example, white toner is used to form images on sheets of black paper or transparent film.

Additionally, sheet types usable as recording media in image forming apparatuses have been increased. Commercially available sheets include metallic sheets having metallic luster and various colored sheets, in particular, black sheets. For example, metal such as aluminum is used to attain metallic luster, and carbon is used to attain clear black.

SUMMARY

An embodiment of the present invention provides an image forming apparatus that includes an image bearer to bear a visible image, a transfer device to transfer the visible image from the image bearer onto a recording medium, a separator to separate the recording medium from the image bearer, a separation bias application device to apply a separation bias to the separator, and a controller to control the separation bias. When the recording medium fed in the image forming apparatus is either a black sheet or a metallic sheet, the controller sets the separation bias smaller than a predetermined separation bias value for a reference sheet type other than the black sheet and the metallic sheet.

Another embodiment provides a method of separating a recording medium from an image bearer in an image forming apparatus. The method includes a step of applying a separation bias to the recording medium, a step of recognizing sheet type of the recording medium, and a step of reducing the separation bias from a predetermined separation bias value for a reference sheet type other than the black sheet and the metallic sheet when either a black sheet or a metallic sheet is fed as the recording medium in the image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
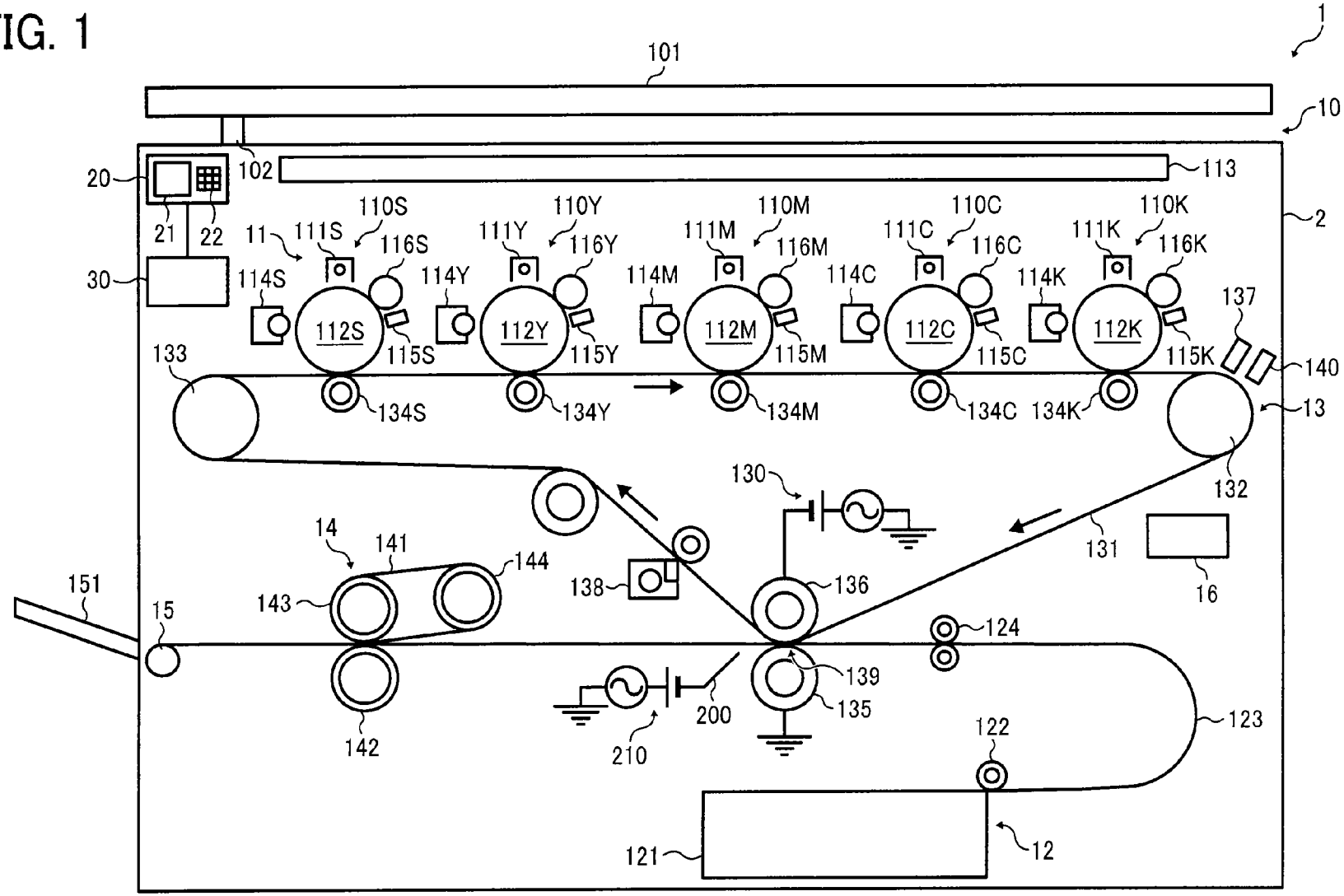
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a basic structure of a multicolor image forming apparatus according to an embodiment of the present invention is described.

An image forming apparatus 1 illustrated in FIG. 1 is a tandem-type multicolor image forming apparatus in which multiple image forming stations are arranged in tandem. The image forming apparatus 1 includes an image reader 10, an image forming unit 11, a sheet feeder 12, a transfer unit 13, a fixing unit 14, and a sheet ejection section 15.

The image reader 10 reads an image of a document to generate image data and includes an exposure glass 101 and a reading sensor 102. The image reader 10 irradiates the document with light, receives light reflected from the document with a sensor such as a charge-coupled device (CCD) or a contact image sensor (CIS), and reads electrical color-separation signals for each of three primary colors of light, i.e., red, green, and blue.

The image forming unit 11 includes image forming stations 110S, 110Y, 110M, 110C, and 110K, respectively for special color, yellow, magenta, cyan, and black.

It is to be noted that the suffixes S, Y, C, M, and K denote the special color, yellow, cyan, magenta, and black, respectively. The term "special color" herein refers to a color, such as transparent (i.e., clear), metallic, or white color, which is not processed by mixing primary color toners, namely, yellow, cyan, magenta, and black. To simplify the description, the suffixes S, Y, M, C, and K indicating colors are omitted when color discrimination is not necessary.

The image forming stations 110S, 110Y, 110M, 110C, and 110K are similar in configuration, differing only in the color of toner employed. The image forming stations 100S, 100Y, 100M, 100C, and 100K are replaced when their operational live expire. Each of the image forming stations 110S, 110Y, 110M, 110C, and 110K is removably mountable as a process cartridge in an apparatus body 2 of the image forming apparatus 1.

It is to be noted that, the arrangement of the image forming stations 110 (in color order) in the image forming unit 11 illustrated in FIG. 1 is just an example. Alternatively, for example, the image forming station 110S may be extreme downstream (closest to a secondary transfer position) in the direction of rotation of an intermediate transfer belt 131. Such an arrangement is advantageous in that, when metallic sheets or black sheets are used, while toner used as under coat and color toner images can be transferred together at a time.

In the description below, a common structure among the image forming stations 110 is described using, as a representative, the image forming station 110K for forming black toner images.

The image forming station 110K includes a charging device 111K, a photoconductor 112K serving as an image bearer or a latent image bearer, a developing device 114K, a static eliminator 115K, and a photoconductor cleaner 116K. These devices are held in a common holder to be removably mountable in the apparatus body 2 at a time so that they are replaceable together at a time.

The photoconductor 112K includes a drum-shaped base on which an organic photosensitive layer is disposed, with an external diameter of approximately 60 mm. The photoconductor 112K is rotated counterclockwise in FIG. 1 by a driving device. The charging device 111K includes a charging wire which is a charged electrode of a charger. A charging bias is applied to the charging wire to cause electrical discharge between the charging wire and an outer circumferential surface of the photoconductor 112K, thereby uniformly charging the surface of the photoconductor 112K. In the present embodiment, the photoconductor 112K is uniformly charged in a negative polarity, which is identical to a normal charging polarity of toner. The charging bias in the present embodiment is a superimposed voltage including an alternating current (AC) voltage superimposed on a direct current (DC) voltage. Alternatively, instead of the above-described charger, in some embodiments, a charging roller that contacts the photoconductor 112K or is disposed near the photoconductor 112K is employed.

The uniformly charged surface of the photoconductor 112K is scanned with a light beam projected from an exposure device 113, thereby forming an electrostatic latent image on the surface of the photoconductor 112K. The potential of the irradiated portion of the photoconductor 112K is attenuated and becomes smaller than the potential of other areas, that is, the background portion (non-image portion). Thus, the irradiated portion becomes an electrostatic latent image. The electrostatic latent image on the photoconductor 112K is developed with black toner by the developing device 114K into a black toner image (i.e., a visible image). The toner image is transferred primarily onto the intermediate transfer belt 131.

The developing device 114K includes a container to store a two-component developer including black toner and carrier, and a developing sleeve is disposed inside the container. A magnetic roller is disposed inside the developing sleeve, and magnetic force exerted by the magnetic roller attracts the developer onto the surface of the developing sleeve. A developing bias identical in polarity to toner is applied to the developing sleeve. The developing bias is greater in potential than the electrostatic latent image on the photoconductor 112K, but smaller in potential than the charging potential of the photoconductor 112K. Then, between the developing sleeve and the electrostatic latent image on the photoconductor 112K, a developing potential to move toner from the developing sleeve to the electrostatic latent image acts. Additionally, a non-developing potential acts between the developing sleeve and the background portion or the non-image formation area of the photoconductor 112K, attracting the toner on the developing sleeve. The developing potential and the non-developing potential cause the black toner to selectively adhere to the electrostatic latent image on the photoconductor 112K, thereby forming a black toner on the photoconductor 112Y.

The static eliminator 115K removes electrical charges remaining the surface of the photoconductor 112K after the toner image is transferred primarily onto the intermediate transfer belt 131. The photoconductor cleaner 116K includes a cleaning blade and a cleaning brush to remove toner remaining on the surface of the photoconductor 112K after the static eliminator 115K removes electrical charges from the surface of the photoconductor 112K.

In other image forming stations 110C, 110M, 110Y, and 110S as well, toner images are formed on the respective photoconductors 112C, 112M, 112Y, and 112S.

The exposure device 113 serving as a latent image writer is disposed above the image forming stations 110S, 110Y, 110M, 110C, and 110K. The exposure device 113 illuminates the photoconductors 112S, 112Y, 112M, 112C, and 112K with laser light emitted from a light source, such as a laser diode, according to image data transmitted from external devices such as the image reader 10 or a personal computer (PC).

The exposure device 113 includes a polygon mirror, a plurality of optical lenses, and mirrors. The light beam projected from the laser diode serving as the light source is deflected in a main scanning direction by the polygon mirror rotated by a polygon motor. The deflected light, then, irradiates the photoconductors 112S, 112Y, 112M, and 112C, and 112K through the optical lenses and mirrors. Instead of using laser light, alternatively, the exposure device 113 may employ a plurality of light emitting diodes (LED) to emit LED light for optical writing.

The sheet feeder 12 feeds sheets of recording media to the transfer unit 13. The sheet feeder 12 includes a sheet tray 121, a pickup roller 122, a conveyor belt 123, and a pair of registration rollers 124. The pickup roller 122 rotates to pick up the sheet stored in the sheet tray 121 and feeds the sheet to the conveyor belt 123. The pickup roller 122 sends out sheets from the sheet tray 121 one by one from the top to the conveyor belt 123. The conveyor belt 123 transports the sheet picked up by the pickup roller 122 to the transfer unit 13. The pair of registration rollers 124 feeds the sheet to a secondary transfer nip 139, where the intermediate transfer belt 131 contacts or positioned close to a secondary transfer roller 135, timed to coincide with arrival of the toner image on the intermediate transfer belt 131 at the secondary transfer nip 139.

The transfer unit 13 is disposed below the image forming stations 110S, 110Y, 110M, 110C, and 110K. The transfer unit 13 includes a driving roller 132, a driven roller 133, the intermediate transfer belt 131, primary transfer rollers 134S, 134Y, 134M, 134C, and 134K, the secondary transfer roller 135, a secondary-transfer opposed roller 136, a toner detector 137, and a belt cleaning device 138. The transfer unit 13 further includes a primary-transfer power source and a secondary-transfer power source 130.

The intermediate transfer belt 131 is entrained around and stretched taut by the driving roller 132, the driven roller 133, the secondary-transfer opposed roller 136, the primary transfer rollers 134S, 134Y, 134M, 134C, and 134K, and so forth, which are disposed inside the loop formed by the intermediate transfer belt 131. The intermediate transfer belt 131 serves as an endless intermediate transfer body.

The driving roller 132 is driven to rotate clockwise in FIG. 1 by a drive device, and the rotation of the driving roller 132 enables the intermediate transfer belt 131 to endlessly move clockwise while contacting the photoconductors 112S, 112Y, 112M, 112C, and 112K.

The intermediate transfer belt 131 has a thickness of 20 μm to 200 μm, preferably, of approximately 60 μm. The intermediate transfer belt 131 according to the present embodiment has a surface resistivity of about 11±0.5 log Ω/sq and a volume resistivity of about 8.5±1 log Ω·cm.

In the configuration illustrated in FIG. 1, the toner detector 137 is disposed above and in proximity to the intermediate transfer belt 131 looped around the driving roller 132 with a certain space secured therebetween. The toner detector 137 detects an amount of toner transferred onto the intermediate transfer belt 131, that is, the amount of toner forming the toner image thereon. The toner detector 137 includes a reflective-type photosensor, for example. The toner detector 137 measures the amount of toner adhering to the intermediate transfer belt 131 by detecting the amount (e.g., intensity) of light reflected from the toner image (including a special color toner) on the intermediate transfer belt 131.

It is to be noted that, considering the above-described function, a typical sensor to detect image density can double as the toner detector 137. In this case, an additional toner detector is not required, thereby reducing the number of constituent parts and hence reducing the cost. Alternatively, in some embodiments, the toner detector 137 is disposed adjacent to the photoconductor 112 to detect the toner image on the photoconductor 112.

The primary transfer rollers 134S, 134Y, 134M, 134C, and 134K are disposed opposite the respective photoconductors 112S, 112Y, 112M, 112C, and 112K via the intermediate transfer belt 131, and are rotated to move the intermediate transfer belt 131. Portions where the outer surface or an image bearing surface of the intermediate transfer belt 131 contacts the photoconductors 112S, 112Y, 112M, 112C, and 112K are called primary transfer nips.

A primary transfer bias is applied to each of the primary transfer rollers 134S, 134Y, 134M, 134C, and 134K by a primary-transfer power source. Accordingly, a transfer electrical field is formed between the primary transfer rollers 134S, 134Y, 134M, 134C, and 134K, and the toner images of special color, yellow, magenta, cyan, and black formed on the photoconductors 112S, 112Y, 112M, 112C, and 112K, respectively. The toner images are sequentially transferred onto the intermediate transfer belt 131 and superimposed one atop the other on the intermediate transfer belt 131.

For example, the special color toner image formed on the surface of the photoconductor 112S enters the primary transfer nip as the photoconductor 112S rotates. Then, the special color toner image is primarily transferred from the photoconductor 112S to the intermediate transfer belt 131 by the transfer electrical field and the nip pressure. Subsequently, the intermediate transfer belt 131, on which the special color toner image has been transferred, sequentially passes through the primary transfer nips of yellow, magenta, cyan, and black. Then, the yellow, magenta, cyan, and black toner images (primary color toner images) are primarily transferred from the photoconductors 112Y, 112M, 112C, and 112K and superimposed one atop the other on the special color toner image on the intermediate transfer belt 131 (i.e., a primary transfer process). In the primary transfer process, a composite toner image including the special color toner image and the primary color toner images is formed on the intermediate transfer belt 131.

Each of the primary transfer rollers 134S, 134Y, 134M, 134C, and 134K is an elastic roller having an outer diameter of 16 mm and including a metal core and a conductive sponge layer fixed on the metal core. The metal core is 10 mm in diameter.

A resistance R of the sponge layer is measured based on a current I flowing when a voltage of 1000 V is applied to the metal core of the primary transfer roller 134 in a state in which a grounded metal roller having an outer diameter of 30 mm is pressed against the sponge layer at a load of 10 N. Specifically, the resistance R of the sponge layer is calculated as about $3\times10^7\Omega$ according to Ohm's law, R=V/I, based on the current I flowing when the voltage of 1000 V is applied to the metal core.

The primary-transfer power source applies the primary transfer bias to each of the primary transfer rollers 134S, 134Y, 134M, 134C, and 134K under constant current control. It is to be noted that, instead of the primary transfer rollers 134S, 134Y, 134M, 134C, and 134K, transfer chargers, transfer brushes, or the like are employed in another embodiment.

The secondary transfer roller 135 rotates with the intermediate transfer belt 131 and the sheet interposed between the secondary transfer roller 135 and the secondary-transfer opposed roller 136. Accordingly, the peripheral surface or the image bearing surface of the intermediate transfer belt 131 contacts the secondary transfer roller 135, thereby forming a place of contact, that is, the secondary transfer nip 139. The secondary transfer roller 135 rotates, driven by a driving device, and serves as a nip forming member as well as a transfer device. The secondary-transfer opposed roller 136 serves as a nip forming member as well as an opposed member. The secondary transfer roller 135 is grounded, while a secondary transfer bias is applied to the secondary-transfer opposed roller 136 by a secondary-transfer power source 130 serving as a transfer bias application device.

According to the present embodiment, the secondary-transfer power source 130 includes a direct current (DC) power source and an alternating current (AC) power source and has a capability of outputting, as the secondary transfer bias, a superimposed bias including DC voltage and AC voltage superimposed on the DC voltage. Alternatively, the secondary-transfer power source 130 can output DC voltage (DC bias) as the secondary transfer bias. An output terminal of the secondary-transfer power source 130 is connected to a metal core of the secondary-transfer opposed roller 136. The potential of the metal core of the secondary-transfer opposed roller 136 is similar or the same as the voltage output from the secondary-transfer power source 130.

By applying the secondary transfer bias to the secondary-transfer opposed roller 136, a secondary transfer electrical field is formed between the secondary-transfer opposed roller 136 and the secondary transfer roller 135 so that the toner negative in polarity is transferred electrostatically from the secondary-transfer opposed roller 136 to the secondary transfer roller 135. With this configuration, the toner having the negative polarity on the intermediate transfer belt 131 is moved from the secondary-transfer opposed roller 136 to the secondary transfer roller 135.

When the secondary-transfer power source 130 outputs the DC bias, the polarity of the DC bias is negative, similar to the toner charging polarity. When the superimposed bias is output, the DC component of the superimposed bias is negative in polarity, similar to the toner, and the time-averaged potential of the superimposed bias is negative in polarity similar to the toner. Although the secondary transfer roller 135 is grounded while the superimposed bias is applied to the secondary-transfer opposed roller 136 in the present embodiment, alternatively, in some embodiments, the metal core of the secondary-transfer opposed roller 136 is grounded while the superimposed bias is applied to the secondary transfer roller 135. In such as case, the DC voltage and the DC component are different in polarity from those of the description above.

When coarse surface sheets, such as embossed sheets having a relatively high degree of surface roughness, is used, the superimposed bias is employed to move toner from the intermediate transfer belt 131 to the sheet, thereby transferring relatively the toner to the sheet, while moving the toner back and forth. This configuration facilitates the transfer of toner to recessed portions of the sheet, thus enhancing transfer rate and preventing image failure such as toner dropouts and blank spots.

By contrast, when smooth surface sheets, such as plain paper having a relatively low degree of surface roughness, is used, uneven image density (dark and light pattern) corresponding to the surface roughness of the sheet is less likely to appear on output images. Accordingly, application of secondary transfer bias including only the DC component can achieve desired transfer quality.

The secondary-transfer opposed roller 136 (i.e., a backup roller) has the following characteristics. The outer diameter of the secondary-transfer opposed roller 136 is approximately 24 mm, and the diameter of the metal core is approximately 16 mm. The secondary-transfer opposed roller 136 includes the metal core and a conductive rubber layer made of, for example, acrylonitrile butadiene rubber (NBR), overlying the metal core. The secondary-transfer opposed roller 136 has a volume resistivity of about 7.75±0.25 log Ω·cm.

The secondary transfer roller 135 (the nip forming roller) has the following characteristics. The outer diameter of the secondary transfer roller 135 is approximately 24 mm, and the diameter of the metal core is approximately 14 mm. A conductive rubber layer made of, for example, acrylonitrile butadiene rubber (NBR), overlays the metal core. The secondary transfer roller 135 has a surface resistivity of 8.2±0.8 log Ω/sq and a volume resistivity in a range from 6.1 to 7.3 log Ω·cm.

A separator 200 to assist separation of the sheet from the image bearer (the intermediate transfer belt 131 in the present embodiment) is disposed downstream from the secondary transfer nip 139 (on the right of the secondary transfer nip 139 in FIG. 1) in the direction in which the sheet is transported (sheet conveyance direction). The separator 200 according to the present embodiment includes a saw-tooth-like discharging needle for electrical charge removal, and a separation bias source 210 applies a separation bias to the separator 200. The separation bias source 210 is a high-pressure power source and similar in configuration to the secondary-transfer power source 130.

When the separation bias is a superimposed bias, the AC component of the separation bias has a capability to lower the adhesive force of the sheet to the intermediate transfer belt 131 by neutralizing the electrical charge of the sheet and vibrating the sheet with the AC current. Additionally, the DC component of the separation bias exerts force to distance the sheet from the intermediate transfer belt 131. It is to be noted that, in the present embodiment, a control target value of the DC component of the separation bias is set to a relatively small value, for example, 1 μA, at which image failure such as toner scattering or honeycomb-like unevenness in toner images does not occur. The term "honeycomb-like unevenness" used here means a phenomenon in which the sheet charged in the transfer process causes abnormal electric discharge while the sheet is transported, and the toner image on the sheet is disturbed such that the image density gradually reduces in circular shape and the background is soiled with toner.

Additionally, in the present embodiment, the AC component of the separation bias is controlled under constant voltage control, and the DC component is controlled under constant current control. Specifically, the controller 30 sends, to the separation bias source 210, a signal to control the AC component of the separation bias under constant voltage control.

A potential sensor 140 is disposed outside the loop formed by the intermediate transfer belt 131. More specifically, out of the entire range of the intermediate transfer belt 131 in the circumferential direction (in a shape of arc), the potential sensor 140 faces a portion of the intermediate transfer belt 131 entrained around the driving roller 132, which is grounded, across a gap of approximately 4 mm from the intermediate transfer belt 131. When the toner image primarily transferred on the intermediate transfer belt 131 arrives at the position opposed to the potential sensor 140, the potential sensor 140 measures the surface potential of the toner image.

A certain amount of toner tends to remain untransferred (i.e., residual toner) on the intermediate transfer belt 131 that has passed through the secondary transfer nip 139. The residual toner is removed from the intermediate transfer belt 131 by a cleaning blade of the belt cleaning device 138 that abuts or contacts the surface of the intermediate transfer belt 131.

The fixing unit 14 employs a belt fixing method, and a pressure roller 142 is pressed against a fixing belt 141 formed into an endless loop. The fixing belt 141 is entrained around a fixing roller 143 and a heating roller 144. At least one of the fixing roller 143 and the heating roller 144 includes a heat source such as a heater, a lamp, and an electromagnetic induction type heating device. The fixing belt 141 is nipped between the fixing roller 143 and the pressing roller 142, thereby forming a heated area called a fixing nip between the fixing belt 141 and the pressing roller 142.

The sheet bearing an unfixed toner image on the surface thereof is delivered to the fixing nip at which the surface of the sheet bearing the unfixed toner image tightly contacts the fixing belt 141 in the fixing unit 14. Under heat and pressure, the toner forming the toner image is softened, and the toner image fixed to the sheet, after which the sheet is discharged outside the image forming apparatus 1. In the event of duplex printing in which an image is formed on either side (front side and back side) of the sheet, after the toner image is thus fixed on the front side, the sheet is delivered to a sheet reversing device in which the sheet is reversed. Subsequently, similar to the above-described image forming process, a toner image is formed on the back side of the sheet.

The sheet on which the toner image is fixed in the fixing unit 14 is output onto an output tray 151 from the apparatus body 2 of the image forming apparatus 1 via output rollers of the sheet ejection section 15.

Generally, in image forming apparatuses, depending on the sheet type of the recording medium used, there is a possibility of occurrence of image failure. For example, when metallic sheets or black sheets are used, streaky image density unevenness can appear.

Conceivable causes of the streaky image density unevenness include the relation between the secondary transfer bias and the separation bias, and effects of sheet properties. As the separation bias increases, electrical charges accumulate on the back side of the sheet, the outer surface of the intermediate transfer belt 131, or both. The accumulating electrical charges cause electrical discharge in constant cycles, and toner is reversely charged. Thus, image density becomes uneven cyclically corresponding to the pitch of the electrical discharge, in a streaky pattern. Alternatively, since the resistance of the sheet is lower, the secondary transfer bias interferes with the separation bias, resulting in leak or discharge. The transfer rate significantly decreases in the discharged portion, and streaky image density unevenness occurs.

This phenomenon is noticeable particularly when metallic sheets and black sheets, which are lower in resistance, is used because the current flowing upon application of AC voltage is greater when the resistance of the sheet is lower.

The inventor of the present invention has found that, when sheets that tend to cause the above-described phenomenon are used, preferable images are attained with streaky image density unevenness reduced by reducing the separation bias.

Figure 2:
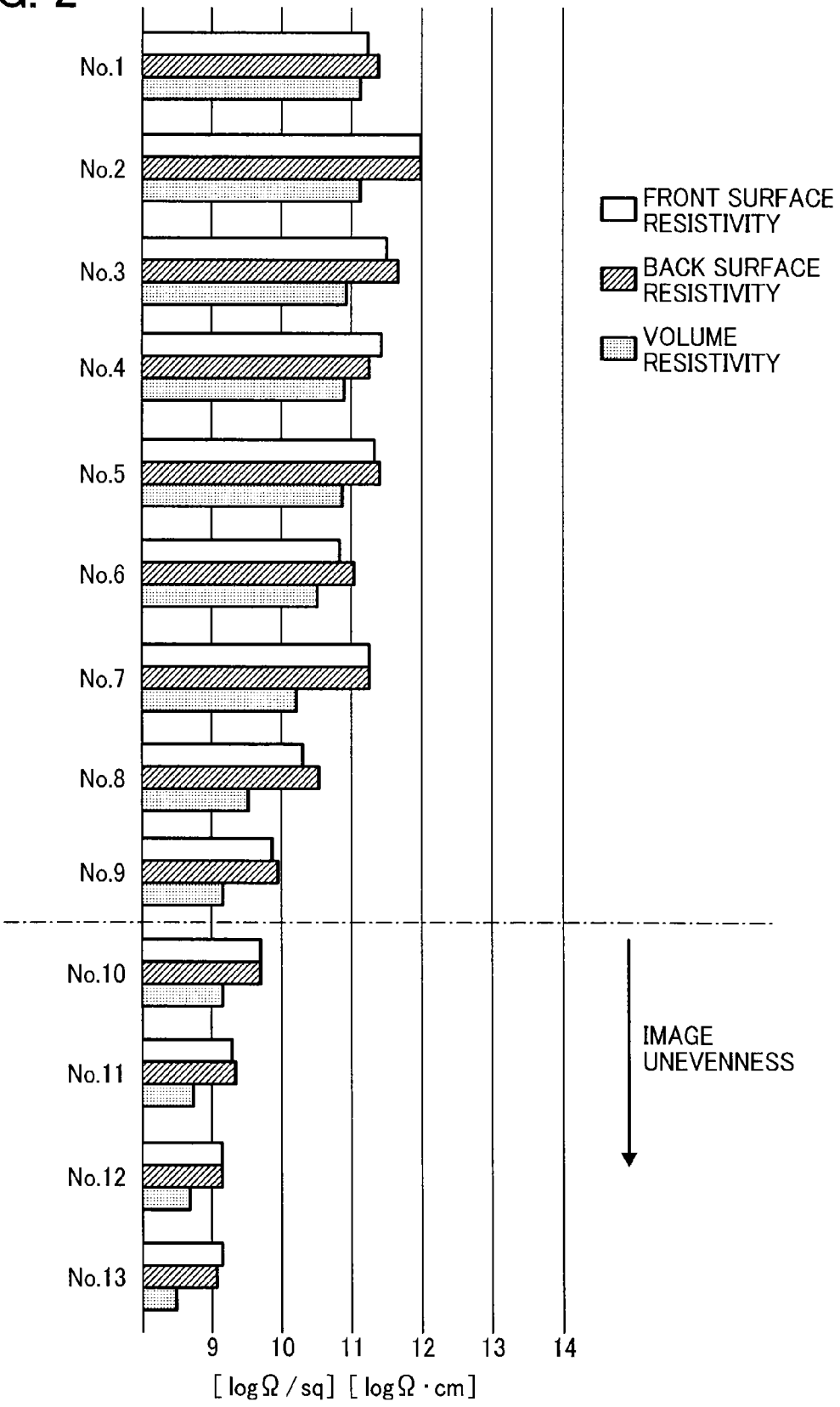
FIG. 2 is a graph of measured resistivity of various sheet types.

FIG. 2 is a graph of measured resistivity of various sheet types (sheet types Nos. 1 through 13) different in resistivity.

As illustrated in FIG. 2, the resistivity of the sheet differs significantly depending on sheet type, and, at the most, the resistivity of one sheet type is about a square of the resistivity of another sheet type.

In an experiment performed by the inventor using these sheet types and a conventional image forming apparatus, streaky image density unevenness occurred when the sheet had a surface resistivity smaller than 10 log Ω/sq and a volume resistivity equal to or smaller than 9.2 log Ω·cm. It is to be noted that the surface resistivity was measured according to JIS (Japanese Industrial Standards) K 6911, and the voltage applied was 500 V. The value after 10 seconds from the voltage application was adopted. The sheet had been left under a temperature of 23° C. and a relative humidity (RH) of 50% for 10 hours.

Referring to FIG. 2, the sheet type No. 9 has a volume resistivity of 9.18 log Ω·cm, a front surface resistivity of 9.92 log Ω/sq, and a back surface resistivity of 9.89 log Ω/sq. The sheet type No. 10 has a volume resistivity of 9.12 log Ω·cm, a front surface resistivity of 9.75 log Ω/sq, and a back surface resistivity of 9.71 log Ω/sq. While the streaky image density unevenness did not occur on the sheet types Nos. 1 through 9, the streaky image density unevenness occurred on the sheet types Nos. 10 through 13.

Depending on image forming apparatus configuration, the resistivity at which streaky image density unevenness occurs differs, that is, a threshold for the resistivity to cause streaky image density unevenness differs. The inventor has found that preferable images are available by reducing the separation bias (for example, turning off the AC component of the superimposed bias) when the resistivity of the sheet is lower than a certain value. In particular, when the front surface resistivity of the sheet is lower than a certain value, preferable images are available by reducing the separation bias. It is to be noted that preferable images are available by reducing the separation bias, similarly, when the back surface resistivity or the volume resistivity of the sheet is lower than a certain value.

When the separation bias is simply reduced, however, the possibility of sheet jam increases as follows. Specifically, in a case of thin paper lower in weigh per square meters, when the thin sheet exits the transfer nip, the thin sheet may fail to leave the intermediate transfer belt 131 or the secondary transfer roller 135, resulting in sheet jam.

Both of preferable image quality and preferable sheet separating capability can be attained by reducing the separation bias in feeding of low resistance sheets, such as metallic sheets and black sheets, while keeping the separation bias at a predetermined separation bias value for sheet types (i.e., reference sheet type) such as plain paper, other than black sheets and metallic sheets in feeding of other sheets.

Descriptions are given below of control of the separation bias.

When the separation bias is the superimposed bias in which the DC component is superimposed on the AC component, the separation bias can be reduced by, for example, one of:

1) the value of the AC component is made smaller or reduced to zero;

2) the value of the DC component is made smaller or reduced to zero; and 3) both of the value of the AC component and the value of the DC component are made smaller or reduced to zero.

Alternatively, when the separation bias is an AC bias (including only an AC component), the AC bias is made smaller or reduced to zero.

Yet alternatively, when the separation bias is a DC bias (including only a DC component), the DC bias is made smaller or reduced to zero.

In the present embodiment, the superimposed bias is used as the separation bias, and the above-described method 1 (the AC component is made smaller or reduced to zero) is adopted. The control of the separation bias, however, is not limited thereto, and any of the above-mentioned methods attains an effect of this disclosure.

Next, experiments executed by the inventors are described.

A test printer used in the experiment was similar in configuration to that illustrated in FIG. 1. Various types of printing tests were executed using the test printer. Effects of the separation bias in which the AC component was reduced to zero (Embodiment 1 in Table 1) were compared with the separation bias according to Comparative example 1 described below. Regarding the secondary transfer bias and the separation bias, the DC component was controlled under constant current control, and the AC component was controlled under constant voltage control.

It is to be noted that the AC component controlled under constant voltage control was employed because controlling a peak-to-peak voltage Vpp (an amplitude value) of the AC component under constant current control is difficult, that is, controlling the peak-to-peak voltage Vpp under constant voltage control is easier.

The values of the bias serving as reference values are as follows.

COMPARATIVE EXAMPLE 1

Secondary transfer bias, direct current: −82 μA;

Separation bias, direct current: 1 μA, AC voltage: Vpp 9.0 kV, having a frequency of 1 kHz.

It is to be noted that the power supply of frequency of 1 kHz is a general purpose power supply and low in cost.

In the printing tests, sheets were fed at a linear velocity of 415 mm/s.

The following sheets were used.

Black paper A: Kishu colored wood-free paper (very thick) from HOKUETSU KISHU PAPER CO., LTD, having a weight of 124.5 grams per square meter (g/m$^2$);

Metallic sheet: SPECIALITIES No 301-FS from Gojo Paper MFG. CO. Ltd., having a weight of 315 g/m$^2$;

Plain paper A: Ricoh Type 6000 having a weight of 80 g/m$^2$; and

Coated paper A: POD Gross Coat from Oji paper Co., Ltd., having a weight of 128 g/m$^2$.

On each of the above-mentioned four paper types, a halftone image was output, and the occurrence of image failure such as streaky image density unevenness and the like was checked with eyes.

In Comparative example, the secondary transfer bias and the separation bias were as described above. In Embodiment 1, the secondary transfer bias was identical to Comparative example 1, and the AC voltage of the separation bias was turned off (Vpp=0 kV). That is, the separation bias in Embodiment 1 included the DC component only. The sheets were fed under ordinary temperature and humidity.

Regarding sample images evaluated, to keep the state of developer uniform, after an image having an image area ratio of about 9% for each color was printed on 250 sheets, a halftone image was output on five sheets. Then, the images were evaluated. The images were regarded as "Good" when image failure did not occur and as "Poor" when image failure such as streaky image density unevenness occurred, as shown in Table 1 below.

TABLE 1

| | Comparative example 1 | Embodiment 1 |
|---|---|---|
| Black paper A | Poor | Good |
| Metallic sheet | Poor | Good |
| Plain paper A | Good | Good |
| Coated paper A | Good | Good |

According to Table 1, compared with Comparative example 1, Embodiment 1 is effective in inhibiting image failure such as streaky image density unevenness.

Additionally, thin sheets were fed in the test printer to check the occurrence of sheet jam and evaluate the sheet separation capability. The following sheet types were used. It is to be noted that the metallic sheet is excluded since thin metallic sheets are not commercially available currently.

Black paper B: Kishu colored wood-free paper (thin) from HOKUETSU KISHU PAPER CO., LTD, having a weight of 60.5 g/m$^2$;

Plain paper B: Fine paper OK Prince from Oji paper Co., Ltd., having a weight of 52.3 g/m$^2$; and Coated paper B: OK Top Coat+ from Oji paper Co., Ltd., having a weight of 73.3 g/m$^2$.

In Comparative example, the secondary transfer bias and the separation bias were as described above. In Embodiment 1, the secondary transfer bias is identical to Comparative example 1, and the AC voltage of the separation bias was turned off (Vpp=0 kV). That is, the separation bias in Embodiment 1 included the DC component only. The sheets were fed under ordinary temperature and humidity.

For each of the above-mentioned sheet types, 25 sheets were fed without forming images thereon, and the sheet separation capability was regarded as "Good" when sheet jam did not occur and as "Poor" when sheet jam occurred, as shown in Table 2.

TABLE 2

| | Comparative example 1 | Embodiment 1 |
|---|---|---|
| Black paper B | Good | Good |
| Plain paper B | Good | Poor |
| Coated paper B | Good | Poor |

It can be known from Table 2 that sheet jam occurs when the separation bias is made smaller in feeding of plain paper or coated paper. By contrast, when the separation bias is not reduced, there is the possibility of image failure in feeding of metallic sheets and black sheets as known from Table 1. Therefore, changing the apparatus conditions in accordance with sheet type (classified based on sheet resistance) is advantageous in attaining preferable image output while inhibiting sheet jam as well as image failure.

From this point, it is understood that changing (i.e., controlling) the separation bias is effective in inhibiting image failure such as streaky image density unevenness, which tends to occur when the transfer bias is the superimposed bias including the DC voltage and the AC voltage superimposed on the DC voltage. Then, preferable images are produced.

In the image forming apparatus 1 according to the present embodiment, when plain paper is used, the DC bias is used as the secondary transfer bias, and the superimposed bias is used as the separation bias to attain necessary transfer performance while securing sheet separation performance to prevent sheet jam.

Additionally, when metallic sheets or black sheets are used, the DC bias is used as the secondary transfer bias, and the separation bias is made smaller (for example, reducing the AC component of the superimposed bias or turning off the AC component). Accordingly, while preferable sheet separation performance is secured, the occurrence of image failure such as streaky image density unevenness is inhibited.

It is to be noted that the secondary transfer bias is not limited to the DC bias, and effects of this specification are attained when the superimposed bias is used as the secondary transfer bias.

Additionally, since metallic sheets and black sheets are easy to separate from the intermediate transfer belt 131, the possibility of sheet jam is smaller even when the separation bias is made smaller. Metallic sheets and black sheets are lower in resistance and thus attraction of sheets to the intermediate transfer belt is weaker compared with plain paper. Therefore, metallic sheets and black sheets are separable only by self stripping due to curvature of the secondary transfer position.

The image forming apparatus 1 according to the present embodiment includes a control panel 20 provided with a display part 21 and an input device 22 such as numeric key pad and a start button. For example, a controller 30 of the image forming apparatus 1 stores sheet types including "standard sheet" such as plain paper, "black sheet" and "metallic sheet", selectable by users, and the display part 21 displays the sheet types. The controller 30 may be a computer including a central processing unit (CPU) and associated memory units (e.g., ROM, RAM, etc.). The computer performs various types of control processing by executing programs stored in the memory. Field programmable gate arrays (FPGA) may be used instead of CPUs. The selectable sheet types are correlated with separation bias setting in a table, which may be stored in the controller 30 or a server, computers, or the like electrically connected to the image forming apparatus 1.

The input device 22 serves as a selection input device, and users can select the sheet type, such as "black sheet" and "metallic sheet", from the sheet types using the input device 22 of the control panel 20. According to the input made by the input device 22, the controller 30 determines the sheet type and, for example, refers to the table in which the separation bias setting is correlated with the sheet type.

When the user selects "black sheet" or "metallic sheet", the separation bias is reduced as described above, thereby inhibiting the occurrence of image failure such as streaky image density unevenness. For example, the AC component of the separation bias is reduced to zero.

As described above, black sheets usually include carbon to the make black color clear, and metallic sheets usually include metal such as aluminum to have metallic luster.

Figure 3A:
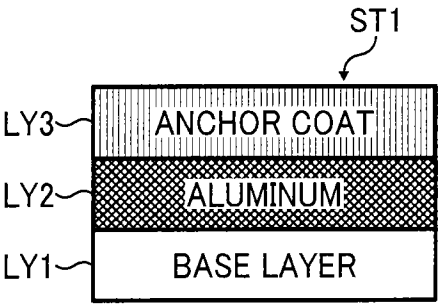
FIGS. 3A, 3B, and 3C are schematic diagrams illustrating structures of metallic sheets according to an embodiment.
Figure 3B:
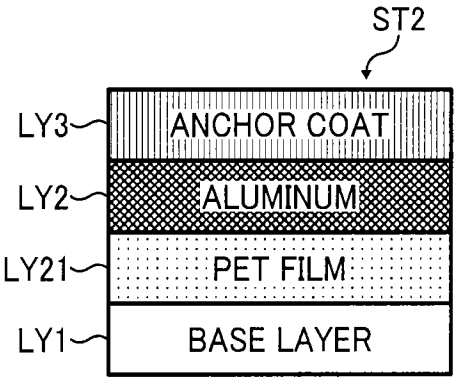
Figure 3C:
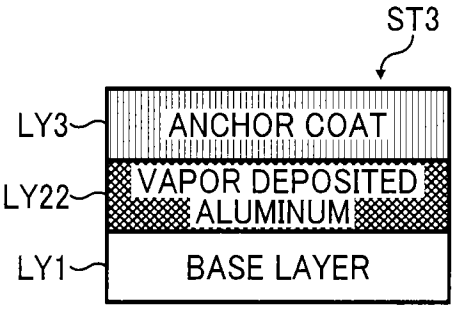

FIGS. 3A, 3B, and 3C illustrate example layer structures of metallic sheet.

Referring to FIG. 3A, a metallic sheet ST1 includes a base layer LY1 made of paper, an aluminum layer LY2, and an anchor coat LY3. Referring to FIG. 3B, a metallic sheet ST2 includes the base layer LY1, a polyethylene terephthalate (PET) film LY21, the aluminum layer LY2, and the anchor coat LY3. Referring to FIG. 3C, a metallic sheet ST3 includes the base layer LY1, a vapor deposited aluminum LY22, and the anchor coat LY3.

For example, an aluminum deposition transfer sheet is bonded to a sheet of paper, release paper is removed, and an anchor coat is applied to the surface of the sheet from which the release paper is removed.

Since such metallic sheets and black sheets are significantly low in resistivity, it is possible that, upon application of the separation bias, the separation bias interferes with the secondary transfer bias, and image failure such as streaky image density unevenness is caused by leak or discharge. By contrast, according to the present embodiment, image failure and leak and discharge are inhibited by reducing the separation bias when the above-described low resistance sheets are fed in the image forming apparatus 1. As described above, since black sheets and metallic sheets excel in separation capability, separation of black sheets and metallic sheets is not degraded by the reduction in the separation bias.

Table 3 shows resistivity of examples of commercially available black sheets. Each resistivity in Table 3 was obtained in a laboratory under ordinary room temperature and humidity using a resistivity meter, Hiresta, and the voltage applied was changed from 10 V to 100 V, 500 V, and 1000 V. The voltage application time was 10 seconds.

TABLE 3

| Sheet | g/cm$^2$ | Sheet thickness (μm) | Applied voltage (V) | Surface resistivity (logΩ/sq) | Volume resistivity (logΩ · cm) |
|---|---|---|---|---|---|
| Black 1 (Lumina Color Black) | 127 | 135 | 10 | under | — |
| | | | 100 | under | 10.9 |
| | | | 500 | under | 9.5 |
| | | | 1000 | under | 14.4 |
| Black 2 | 116 | 150 | 10 | — | — |
| | | | 100 | 11.0 | 10.0 |
| | | | 500 | 10.9 | 9.7 |
| | | | 1000 | 11.0 | 9.6 |
| Black 3 | 116 | 150 | 10 | 5.2 | under |
| | | | 100 | under | under |
| | | | 500 | under | under |
| | | | 1000 | under | under |
| Black 4 | 116 | 160 | 10 | 6.7 | 5.6 |
| | | | 100 | under | under |
| | | | 500 | under | under |
| | | | 1000 | under | under |
| Black 5 | 116 | 180 | 10 | 5.3 | 6.1 |
| | | | 100 | under | under |
| | | | 500 | under | under |
| | | | 1000 | under | under |
| Black 6 | 245 | 330 | 10 | 5.7 | 5.8 |
| | | | 100 | under | under |
| | | | 500 | under | under |
| | | | 1000 | under | under |
| Black 7 | 116 | 145 | 10 | — | — |
| | | | 100 | 11.0 | 10.2 |
| | | | 500 | 10.9 | 10.0 |
| | | | 1000 | 10.9 | 9.9 |
| Black 8 | 140 | 210 | 10 | 5.1 | under |
| | | | 100 | under | under |
| | | | 500 | under | under |
| | | | 1000 | under | under |
| Black 9 | 140 | 145 | 10 | — | — |
| | | | 100 | 10.9 | 10.4 |
| | | | 500 | 10.9 | 10.2 |
| | | | 1000 | 10.9 | 10.1 |
| Black 10 | 245 | 340 | 10 | 5.0 | 4.8 |
| | | | 100 | under | under |
| | | | 500 | under | under |
| | | | 1000 | under | under |
| Black 11 | 154 | 180 | 10 | under | under |
| | | | 100 | under | under |
| | | | 500 | under | under |
| | | | 1000 | under | under |
| Black 12 | 216 | 290 | 10 | — | — |
| | | | 100 | 10.6 | 9.9 |
| | | | 500 | 10.5 | 9.8 |
| | | | 1000 | 10.4 | 9.5 |

In Table 3, the sheet whose resistivity is marked as "under" is the above-described black sheets having a significantly low resistivity. The effects of the present embodiment were ascertained on the black sheets shown in Table 3, including those significantly low in resistivity.

It is to be noted that, although typical black sheets include carbon and typical metallic sheets include metal such as aluminum, most users do not know the ingredients and the structure of sheets.

When the image forming apparatus is configured to make users designate the sheet type including the ingredients and the structure of the sheet, more delicate control is available, but setting work of users are more complicated. In view of the foregoing, in the present embodiment, sheets that look black are regarded as black sheets regardless of whether the sheets include carbon, and the separation bias is reduced in that case as described above.

The resistance of black sheets free of carbon is not as low as the resistance of the black sheets including carbon. However, considering that most users do not have knowledge of sheet resistivity, the present embodiment inhibits the occurrence of image failure such as streaky image density unevenness without burdening users with complicated setting work. Although the sheet separation capability is lowered by the reduction in the separation bias, black sheets, even those free of carbon, are better in the separation capability than white sheets of plain paper. Thus, this operation does not cause an inconvenience.

Similarly, there are sheets free of a metal layer but have a metallic appearance. In this case, also, the sheets that look metallic sheets are regarded as metallic sheets regardless of whether the sheets include a metal layer, and the separation bias is reduced in that case, as described above.

The resistance of sheets having metallic luster without a metal layer is not as low as the resistance of the metallic sheets including a metal layer. However, considering that most users do not have knowledge of sheet resistivity, the present embodiment inhibits the occurrence of image failure such as streaky image density unevenness without burdening users with complicated setting work. Although the sheet separation capability is lowered by the reduction in the separation bias, metallic sheets, even those free of a metal layer, are better in the separation capability than white sheets of plain paper. Thus, this operation does not cause an inconvenience.

However, how to designate "black sheet" and "metallic sheet" is not limited to the description above. For example, in another embodiment, to control application of the separation bias more delicately, black sheets extremely lower in resistivity and other black sheets are regarded as different sheet types, and a metallic sheets extremely lower in resistivity and other metallic sheets are regarded as different sheet types.

In another embodiment, the controller 30 reduces the separation bias when the resistance value of the sheet is equal to or lower than a threshold.

Other than metallic sheets and black sheets, there are sheet types lower in resistance value (for example, smaller than $10^{10}$ Ω), and there are possibilities of image failure, electrical leak, and electrical discharge when such sheet types are used. Therefore, in this embodiment, selectable sheet types displayed on the display part 21 of the control panel 20 include "low resistance sheet", and the separation bias is made smaller when "low resistance sheet" is selected via the input device 22 on the control panel 20. That is, the input device 22 serves as the selection input device to input, to the controller 30, whether the resistance value of the recording medium is equal to or smaller than a threshold resistance value.

For example, when the separation bias is the superimposed bias, the AC component is set to zero.

This configuration is advantageous in that the occurrence of leak, discharge, and image failure, such as streaky image density unevenness, is inhibited, in addition to the case of metallic sheets and black sheets, in the case of other sheets having a lower resistance value. Accordingly, images can be transferred preferably regardless of sheet feeding conditions.

In yet another embodiment, when either "black sheet" or "metallic sheet" is selected and a special color mode is selected, the secondary transfer bias is increased and the separation bias is reduced.

It is to be noted that "special color mode" used here means an image forming operation in which an image including the special color toner is transferred onto the sheet, and "special color mode" includes image forming operation using the special color toner only and image forming operation using the special color toner in addition to at least one of the primary color toners. In the image forming apparatus 1 illustrated in FIG. 1, the special color toner is the toner other than cyan, magenta, yellow, and black toners, and the special color toner is used in the image forming station 110S positioned at the first from the left in FIG. 1.

An example of the special toner is white toner. For example, a white background is formed using the white toner on a part of a black sheet or a metallic sheet, and a letter or an image is formed using at least one of cyan, magenta, yellow, and black toners on the white background. Another example of the special color toner is transparent toner used to enhance gloss level.

In the special color mode, the amount of toner transferred onto the sheet is greater compared with standard image forming operation in which the special color toner is not used. Accordingly, the capability to transfer the image onto the sheet is secured by increasing the secondary transfer bias in the present embodiment. Although increasing the secondary transfer bias increases the possibility of occurrences of leak of electrical current and discharge when the resistance value of the sheet is smaller, such an inconvenience is inhibited by reducing the separation bias in this embodiment.

This embodiment is described in further detail below using "black sheet" as an example.

When the user selects "black sheet" as the sheet type and full-color image formation mode using the special color toner (hereinafter "FCS mode") as the image formation type on the control panel 20, the secondary transfer bias is increased and the separation bias is reduced (in this case, the AC component of the superimposed bias is set to zero), compared with a case where plain paper is selected and full-color image formation mode in which the special color toner is not used (hereinafter "FC mode") is selected.

It is to be noted that full-color images are formed using cyan, magenta, yellow, and black in the FC mode, and images are formed using cyan, magenta, yellow, black, and white toners in the FCS mode. The controller 30 changes the separation bias setting according to a table in which selectable sheet types, image formation modes, transfer bias setting, and separation bias setting are correlated.

Images formed according to this embodiment were evaluated under the following conditions.

Plain paper: Ricoh Type 6000 having a weight of 80 g/m$^2$ (used as comparison with black sheets);

Black paper (two types): Lumina color from Oji F-Tex Co., Ltd., and Kishu colored wood-free paper from HOKUETSU KISHU PAPER CO., LTD;

Selection of sheet type and image formation mode: Selected by user via the control panel;

Secondary transfer bias: −82 μA in FC mode, and −102 μA in FCS mode; and

Target toner adhering amount:

In FC mode, 260% (in total amount when the toner adhering amount of a solid single color image is 100%), 0.895 mg/cm$^2$ at the maximum, In FCS mode, 360% (full color 260% and special color 100%), 0.895+1.155 mg/cm$^2$ at the maximum Table 4 shows the amount of toner adhering to the sheets evaluated under the above-described conditions. It is to be noted that toner adhering amount is adjusted by adjusting the developing bias.

TABLE 4

| Mode | | Single color 100% | FC total amount 260% | FCS total amount 360% |
|---|---|---|---|---|
| FC | Black | 0.380 | 0.895 | FCS White |
| | Cyan | 0.380 | | (center): 1.531 |
| | Magenta | 0.410 | | FCS White |
| | Yellow | 0.380 | | (maximum) 2.05 |
| FCS | White (center) | 0.636 | — | |
| | White (Maximum) | 1.155 | — | |

In Table 4, the amount of white toner adhering to the sheet is 0.636 or 1.155 mg/cm$^2$ in the FCS mode 360%, and this amount is added to the amount of toner adhering to the sheet in the FC mode. Accordingly, in the FCS mode, the maximum amount of toner adhering is calculated as 0.895+1.155=2.05 mg/cm$^2$.

Thus, in the present embodiment, the amount of toner adhering is increased, that is, the transfer capability is increased by increasing the level of the secondary transfer bias in the FCS mode (to −120 μA) from the level in the FC mode (−82 μA). It is to be noted that, by reducing the separation bias, leak of electrical current or electrical discharge did not occur, and image failure such as streaky image density unevenness was not recognized.

As described above, in the embodiments of the present invention, the separation bias applied to the separator 200, which separates the sheet from the intermediate transfer belt 131 serving as the image bearer, is reduced, when a black sheet or a metallic sheets is fed as the recording medium in the image forming apparatus 1. Accordingly, image failure, electrical current leak, and electrical discharge are inhibited, and preferable transfer performance is attained regardless of the sheet feeding conditions.

Additionally, the image forming apparatus 1 allows the user to designate the sheet as "black sheet" or "metallic sheet" by the appearance of the sheet, without checking whether the sheet include carbon or a metal layer, thereby simplifying the setting work made by the user while inhibiting the occurrence of image failure induced by use of "black sheet" or "metallic sheet".

Alternatively, when the resistance value of the recording medium is equal to or smaller than the threshold, the controller 30 reduces the separation bias applied to the separator. With this operation, in the case of sheets having a lower resistance value, including metallic sheets and black sheets, the occurrence of electrical current leak, discharge, and image failure such as streaky image density unevenness is inhibited. Accordingly, images can be transferred preferably regardless of the sheet feeding conditions.

Additionally, by using the superimposed bias including the DC component and the AC component as the separation bias, sheet separation capability is improved.

Additionally, the separation bias is made smaller by reducing the AC component, thereby inhibiting the occurrence of image failure while securing the sheet separation capability.

Additionally, controlling the AC component of the separation bias under constant voltage control is advantageous in that the amplitude value of the AC component can be controlled more easily, thereby making the control of the separation bias easier.

Additionally, when either "black sheet" or "metallic sheet" is selected from the selectable sheet types and the special color mode is selected as the image forming operation mode, the transfer bias is increased and the separation bias is reduced. This operation is effective in securing the transfer capability in the special color mode employing the special color toner, in which the amount of toner adhering to the sheet is greater, while inhibiting the occurrence of electrical current leak, discharge, and image failure such as streaky image density unevenness.

Additionally, making the separation bias smaller in feeding of black sheets including carbon is advantageous in inhibiting the occurrence of electrical current leak, discharge, and image failure such as streaky image density unevenness when the black sheets extremely lower in resistance value is used.

Additionally, making the separation bias smaller in feeding of metallic sheets including the metal layer is advantageous in inhibiting the occurrence of electrical current leak, discharge, and image failure such as streaky image density unevenness when the metallic sheets extremely lower in resistance value is used.

It is to be noted that the aspects of this specification are not limited to the embodiments described above using the drawings.

For the secondary transfer mechanism and the separator 200, different structures can be adopted as required. Similarly, for the power source to apply the transfer bias or the separation bias, a different structure can be adopted as required. Additionally, values of the separation bias and the like are not limited to the examples described above but can be set to different values as required. Regarding the transfer bias, the effects of this specification are attained when either the DC bias or the superimposed bias is used as the transfer bias.

The above-described ingredients, structure, and resistance value of the black sheet and metallic sheet are just examples, and the black sheet and metallic sheet relating to this specification are not limited thereto. The term "black sheets" used in this specification are not limited to sheets of paper and include sheets colored black and usable to record toner images. The term "metallic sheets" are not limited to sheets of paper and include sheets having metallic luster and usable to record toner images. For example, "sheet" used herein includes OHP (overhead projector) sheet, cloth sheet, glass sheet, leather sheet, metal sheet, plastic sheet, wood sheet, ceramic sheet, or substrate to which toner or ink can adhere.

Additionally, the embodiments of the present invention are not limited to image forming apparatuses employing an intermediate transfer method but can adapt to image forming apparatuses employing a direct transfer method.

Yet additionally, the structure of the image forming apparatus can be changed as required, and the arrangement order of the multiple different color image forming stations in a tandem system can be changed as required. For example, the embodiments are not limited to image forming apparatuses including five image forming stations but can adapt to image forming apparatuses including four image forming stations. Needless to say, the image forming apparatus is not limited to a copier. Alternatively, the image forming apparatus may be a printer, a facsimile machine, or a multifunction device (i.e., MFP) having a plurality of capabilities.

In the direct transfer method, respective toner images are transferred from multiple photoconductors and superimposed one on another on a sheet (i.e., a recording medium) carried on a conveyor such as a conveyor belt disposed facing the multiple photoconductors. That is, in the image forming apparatus 1 illustrated in FIG. 1, instead of the intermediate transfer belt 131, a conveyor belt to transport the sheet is disposed facing the multiple photoconductors 112, and the toner image are transferred from the multiple photoconductors 112 onto the sheet carried on the conveyor belt.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising an image bearer to bear a visible image;

a transfer device to transfer the visible image from the image bearer onto a sheet;

a separator to separate the sheet from the image bearer;

a separation bias application device to apply a separation bias to the separator; and a controller to control the separation bias; and a selection input device to input, to the controller, a selected sheet type selected by a user, wherein, when either a black sheet or a metallic sheet is selected as the selected sheet type by the selection input device, the controller sets the separation bias smaller than a predetermined separation bias value for a reference sheet type other than the black sheet and the metallic sheet, regardless of whether the sheet includes carbon and regardless of whether the sheet includes a metal layer.

2. The image forming apparatus according to claim 1, wherein the selection input device is configured to input, to the controller, whether a resistance value of the sheet is equal to or smaller than a threshold resistance value, wherein, when the resistance value of the sheet is equal to or smaller than the threshold resistance value, the controller sets the separation bias smaller than the predetermined separation bias value.

3. The image forming apparatus according to claim 1, wherein the separation bias application device applies, as the separation bias, a superimposed bias including a DC component and an AC component to the separator.

4. The image forming apparatus according to claim 3, wherein, the controller sets the AC component smaller to set the separation bias smaller.

5. The image forming apparatus according to claim 3, wherein the controller controls the AC component of the separation bias under constant voltage control.

6. The image forming apparatus according to claim 1, further comprising:

a transfer bias application device to apply a transfer bias to the transfer device, wherein the selection input device is configured to input, to the controller, a selected image formation mode, and the image forming apparatus has multiple different image formation modes including a special color mode in which a special color toner is used, and when the selected sheet type is either the black sheet or the metallic sheet and the selected image formation mode is the special color mode, the controller sets the transfer bias greater and the separation bias smaller.

7. A method of separating a sheet from an image bearer in an image forming apparatus, the method comprising:

applying a separation bias to the sheet;

receiving, from an input selection device, input of a selected sheet type of the sheet selected by a user; and reducing the separation bias from a predetermined separation bias value for a reference sheet type other than a black sheet and a metallic sheet when either the black sheet or the metallic sheet is selected as the selected sheet type by the selection input device, regardless of whether the sheet includes carbon and regardless of whether the sheet includes a metal layer.

8. The image forming apparatus of claim 1, wherein, when either a black sheet or a metallic sheet is selected by the user as the selected sheet type by the selection input device, the controller sets the separation bias based only on the selected sheet type and not on measured resistivity of the sheet or on an actual amount of carbon or metal in the sheet, and sets the separation bias smaller than a predetermined separation bias value for a reference sheet type other than the black sheet and the metallic sheet.

* * * * *